United States Patent [19]

Gaschenko et al.

[11] 3,955,228

[45] May 11, 1976

[54] BOAT SHADE

[76] Inventors: Viktor Petrovich Gaschenko, Bolshoi Prospekt, 46, kv. 45; Vladimir Fedorovich Dzhulai, ulitsa Chekhova, 271"b", kv. 25; Vyacheslav Ivanovich Semenov, ulitsa Engelsa,201; Viktor Alexeevich Serebryakov, ulitsa Svobody, 25/9, kv. 48, all of Taganrog, U.S.S.R.

[22] Filed: Aug. 19, 1975

[21] Appl. No.: 605,821

[52] U.S. Cl. ..... 9/1 B; 135/6

[51] Int. Cl.[2] ..... B63B 17/02

[58] Field of Search ..... 9/1 B; 135/6, 7.1

[56] References Cited

UNITED STATES PATENTS

| | | | |
|---|---|---|---|
| 2,505,520 | 4/1950 | Bills | 9/1 B |
| 2,513,764 | 7/1950 | Vonder Ahe | 135/6 |

*Primary Examiner*—Trygve M. Blix
*Assistant Examiner*—Gregory W. O'Connor
*Attorney, Agent, or Firm*—Haseltine, Lake & Waters

[57] ABSTRACT

The present invention relates to a boat shade comprising a cover and a frame for it formed of three inverted U-shaped components. Two of these inverted U-shaped components, carrying the cover, are arranged so as to flank the third inverted U-shaped component, to which they are hinged, and which is vertically erected and secured by its ends to the sides of a boat. Each of the hinges disposed at each end of each of the inverted U-shaped components, carrying the cover, is formed by an axle arranged at this end of the component and capable or moving in a horizontal direction outwardly in relation to the vertically erected component and a bushing mounted on it. A spring-actuated stop locks the axle in its extreme positions when the cover is either fully unfolded, or when it is partially folded, that is when one of the inverted U-shaped components, carrying the cover, is placed on the other component.

The invention may be used on small vessels and boats meant for tourism and recreation, and, more particularly, as an attachment to foldable boats.

4 Claims, 7 Drawing Figures

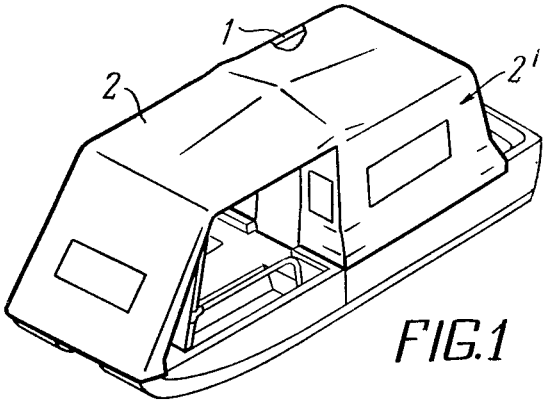
FIG.1
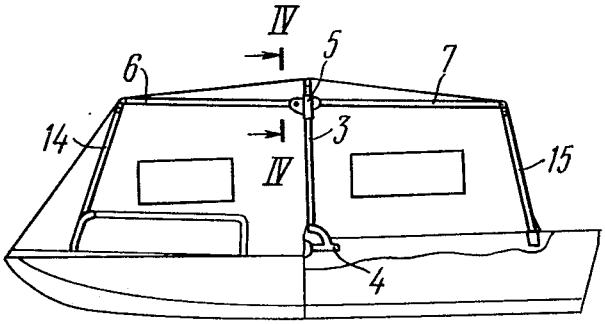
FIG.2
FIG.3
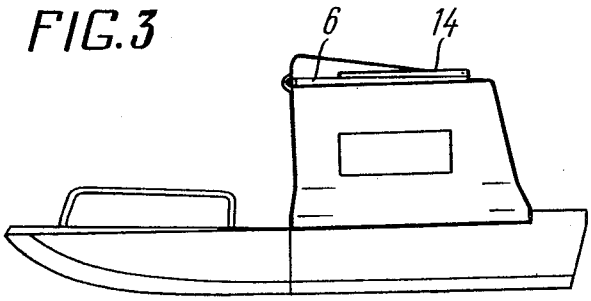

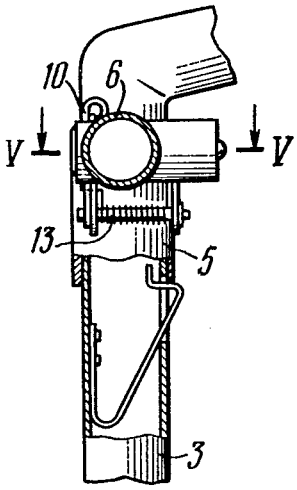
FIG. 4
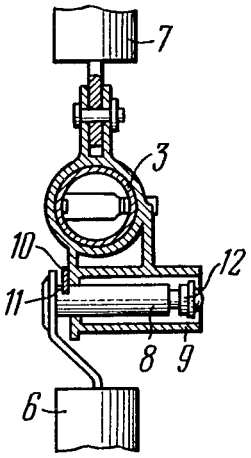
FIG. 5
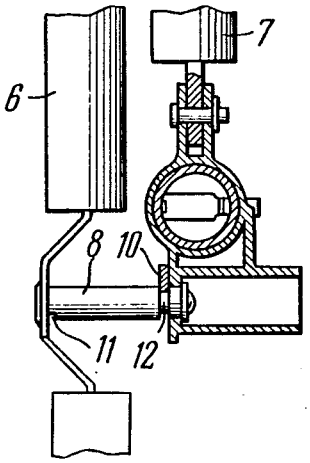
FIG. 6
FIG. 7
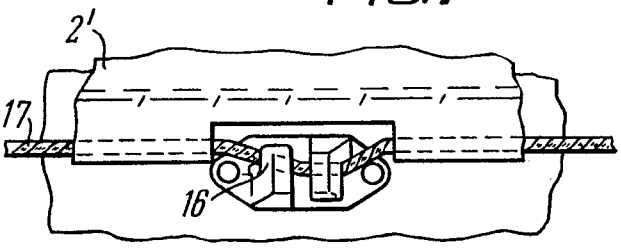

BOAT SHADE

The present invention relates to boat shades attached to small boats or vessels, and more particularly, to boat shades mounted on tourist and recreation boats.

The invention can be used especially effectively on foldable boats.

There are known detachable boat shades for small boats and vessels used for tourism and recreation (cf. for example, U.S. Pat. No. 2,769,451, Cl. 135–6).

Such boat shades comprise a tent-panel and a frame consisting of three inverted U-shaped components. One of these components, have sliders on its sides, is erected vertically and rotatably mounted on the opposite sides of the boat. Two of the other inverted U-shaped components, carrying the cover, are arranged on both sides of the vertically erected component, their ends being hingedly connected to its sliders.

Such boat shades provide protection against direct sunlight and rain, and are convenient since they are easily collapsable thanks to the sliders mounted on the sides of the vertically erected inverted U-shaped component and the hinged connections of the two inverted U-shaped components carrying the cover with said sliders. Each of the hinged connections consists of a cottered pin, which is made with a head and which extends through two ears set on the slider at a distance from one another and through the end portion of the inverted U-shaped component carrying the cover.

Such boat shades provide protection against the direct rays of the sun and against rain, but exclude the possibility of making the boat into an enclosed type of premises suitable for lengthy habitation afloat, for instance, in inclement weather.

There are also known boat shades, which together with the boat, can actually comprise a closed-in type of premises, thanks to the utilization of prop supports that are hingedly secured to the inverted U-shaped components carrying the cover, on the side opposite to the one to which their ends are fixed. The cover can also be arranged between such prop supports.

Such boat shades can be completely folded down, thanks to the hinged connections between all the inverted U-shaped components and the supporting props, and they can also be unfolded and assembled, together with the boat, to form a permanent type of enclosed premises. But such boat shades cannot be assembled partially so as to change the cottage type premises into those of other shapes and dimensions.

The primary object of the present invention is to provide a boat with a cover, in which one of the inverted U-shaped components would have such a connection with a vertically erected inverted U-shaped component as to make it possible to fold one of the inverted U-shaped components, carrying the cover, on the other component, and thereby attain a partial folding of the cover and appreciably improve the general comfort by comparison with other known types of similar boat shades.

This object is attained by providing a boat shade comprising a cover and a frame, the latter consisting of three inverted U-shaped components; one of these components, the one with sliders on its sides, is erected vertically and rotatably mounted on the opposite sides of the boat; the other two components, carrying said cover, are disposed on both sides of the vertically erected component with their ends hingedly connected with said component's sliders, in which, according to the invention, the hinge connecting each end of one of the inverted U-shaped components carrying the cover together with the slider of the vertically erected component, is formed by an axle mounted on this end and able to move in a horizontal direction outwardly in relation to the vertically erected component, and a bushing mounted on the slider holding a spring-actuated stop that locks the axle in its extreme positions when the cover is unfolded or when it is partially folded with one of the inverted U-shaped components, carrying the cover, lying on the other component.

It is advisable that at least one of the inverted U-shaped components, carrying the cover, should have, on the side opposite to its secured end, props hingedly coupled thereto. Such an arrangement will increase the rigidity of the frame.

It is highly advisable to arrange the cover between the supporting props. This will permit the construction of a closed-in type of premises within the confines of the cover and boat.

It is also recommended that the cover where it adjoins the sides of the boat, should have a halyard for securing the cover to the sides of the boat with the aid of hooks, arranged next to one another and facing one opposite another.

This will facilitate both the fastening of the cover and its quick and easy detachment from the sides of the boat if the need arises to transform the boat shade from an enclosed premises into one open on one or several sides.

According to the invention, the proposed boat shade will make a house-boat type of enclosed premises, which as a result of the partial folding of the cover through the pivoting of one of the inverted U-shaped components, carrying the tent-panel, in relation to the vertically erected inverted U-shaped component, and the placing of said first component on the component carrying the cover, may be transformed into an enclosure of a different form and size.

This selectivity of arrangement provides for maximum comfort, especially in the event of a change in the weather, and for those using such a boat shade with a collapsable boat.

Other objects and advantages of the present invention will become more apparent from the following detailed description of a preferred embodiment thereof taken in conjunction with the attached drawings, wherein:

FIG. 1 is a schematic general view of a boat with a shade, in accordance with the invention;

FIG. 2 is a section taken along the longitudinal axis of the boat;

FIG. 3 is a section taken along the longitudinal axis of the boat, with one of the inverted U-shaped components, carrying the shade, placed on another component.

FIG. 4 is an enlarged, partially cut away view of a section taken along the line IV — IV of FIG. 2 with a portion of the shade removed therefrom;

FIG. 5 is a section taken along the line V — V of FIG. 4;

FIG. 6 is a section taken along the line V — V of FIG. 4 showing the hinge's axle locked in one of the extreme positions;

FIG. 7 shows the attachment of the shade to the sides of a boat.

The proposed boat shade consists of a frame 1 (FIGS. 1 and 2) and a cover 2. The frame is composed of three inverted U-shaped components, one of which, a component 3 (FIG. 2) is erected vertically and, with its ends attached to the opposite side of the boat, allowing for pivotal movement with the aid of hinges 4. On each side of this inverted U-shaped component, there is installed one slider 5 which can be moved along those sides. Two other inverted U-shaped components 6 and 7, mounted on both sides of the inverted U-shaped component 3, carry the cover 2. The ends of the inverted U-shaped components 6 and 7, that carry the cover 2, are hingedly connected to the sliders 5, which permit the components 6 and 7 to be turned in relation to the vertically erected inverted U-shaped component 3, when it is desirable to fold the tent-panel, as shown in FIG. 3.

Each end of each of the inverted U-shaped components 6 (FIG. 2) and 7, carrying the cover, is hingedly connected to the slider 5 (FIG. 4), the hinge being formed, according to the invention, by an axle 8 (FIG. 5, 6) able to move in a horizontal direction outwardly in relation to the vertically erected inverted U-shaped component 3 (FIG. 2) and a bushing 9 (FIGS. 5 and 6) rigidly fixed to the slider 5.

A stop 10, fixed to the slider 5 (FIG. 4), enters slots 11 (FIG. 6) and 12, arranged on the ends of the axle 8, urged by a spring 13 (FIG. 4) to keep the axle 8 in extreme positions, corresponding to the cover's unfolded and partially folded state, respectively.

In order to impart rigidity to the cover and form a closed-in premises with the aid of the cover 2 (FIG. 1) and the frame 1, in the corner bends of at least one of the inverted U-shaped components 6 (FIG. 2) and 7 there are hingedly mounted supporting props 14 and 15 between which the cover is fastened. The bottom ends of these props are detachably connected to the boat.

The cover 2 (FIG. 1), as well as a cover 2', fixed between the props 14 and 15, surround the frame, and together with the boat, form an enclosed premises.

The cover 2' is fastened to the sides of the boat with the aid of hooks 16 (FIG. 7) arranged next to each other and facing in opposite directions. Passing through the hooks 16 is a line 17 built into the edge seam of the cover 2'.

The aforementioned embodiment of a boat shade makes it possible to use it with a boat, particularly with a foldable one, in the following ways: as a house-boat vacationing and waterway tourism; as a two-room tourists' house to rest in ashore, and as a one-room house with or without a fore-roof.

To rearrange a two-room cottage house into a one-room house through a partial folding of the boat shade, it is necessary to detach the cover 2' from the boat and fasten it under cover 2. The supporting props 14 are then removed from their lodges, and one of the inverted U-shaped components 6 or 7 is turned together with the cover 2' that has been placed on it folded transeversely in relation to the vertically erected U-shaped component 3 (FIG. 2), thereby laying it on another inverted U-shaped component 7 (FIG. 2) or 6. In this process, the stop 10 (FIGS. 4, 5, and 6) is pushed out of the slot 11 of the axle 8, thus freeing the axle 8, which is withdrawn from the bushing until it is locked by the coil 10 in the slot 12 arranged on the other end of the axle 8.

In the case when one inverted U-shaped component 6 is placed on another, for example, on the component 7, the side props 14 are turned under the effect of their own weight on their hinges and folded on the inverted U-shaped component to which they are fixed. In this way a two-room cottage type of house can be transformed into a one-room premises.

Should it be desirable to use the proposed embodiment with a detachable foldable boat, in that case after a partial folding of the cover in the above-described manner, the bow portion of the boat may be separated from its stern portion which will substantially increase the possibility of using the proposed boat shade for vacationing afloat and for waterway tourism.

What is claimed is:

1. A boat shade comprising: a cover and a frame, carrying said cover; said frame formed of three inverted U-shaped components; one of said inverted U-shaped components of said frame being erected vertically and fastened at its ends to the opposite sides of said boat with the possibility of being pivoted; two other inverted U-shaped components of said frame, arranged on both sides of the vertically erected U-shaped component and carrying said cover; sliders mounted on the sides of the vertically erected U-shaped component of said frame; hinges joining said sliders to the ends of the inverted U-shaped components carrying the cover; each of said hinges, joining each end of one of the inverted U-shaped components of said frame to one of said sliders, is formed by an axle mounted on the end of the inverted U-shaped component carrying the cover, and devised to move in a horizontal direction outwardly in relation to the vertically erected component of said frame, and is further formed by a bushing, mounted on one of said sliders; means mounted on each of said sliders for locking the axle of each of said hinges in the axle's extreme positions when the cover is unfolded or when one of its components, carrying the cover, is folded on the other.

2. A boat shade as claimed in claim 1, in which at least one of the inverted U-shaped components, carrying the cover, on the side opposite the one to which its ends are attached, has hinged props connected to it.

3. A boat shade as claimed in claim 2, in which a cover is also arranged between the supporting props.

4. A boat shade as claimed in claim 3, in which the cover in the portion adjoining the side of the boat, has a line for fastening it to the sides of the boat with the aid of hooks arranged one next to another and facing in opposite directions.

* * * * *